United States Patent [19]

Camilleri

[11] 4,050,695

[45] Sept. 27, 1977

[54] FLEXIBLE PLANK SUPPORT UNIT

[76] Inventor: Thomas M. Camilleri, 277 Avenue W., Brooklyn, N.Y. 11226

[21] Appl. No.: 660,878

[22] Filed: Feb. 24, 1976

[51] Int. Cl.[2] ..... A63D 5/00

[52] U.S. Cl. ..... 273/53

[58] Field of Search ..... 273/43 R, 43 A, 53; 188/268

[56] References Cited

U.S. PATENT DOCUMENTS

| | | | |
|---|---|---|---|
| 1,625,599 | 4/1927 | Gessert | 273/53 UX |
| 2,803,462 | 8/1957 | Zuercher | 273/53 X |
| 3,006,627 | 10/1961 | Paulsen | 188/268 X |
| 3,096,090 | 7/1963 | Albrecht | 273/53 |

OTHER PUBLICATIONS

AMF Parts Catalog, copyright 1953, revised 1959, pp. 24, 62, 63, 70, 71 relied on.

*Primary Examiner*—Anton O. Oechsle
*Attorney, Agent, or Firm*—Donald J. Perrella

[57] ABSTRACT

The supporting arms of the plank support unit for an automatic pinsetting machine are attached to the horizontal shaft by upper and lower portions which are detachably secured to one another around the shaft. Cushioning material is disposed between the portions and the shaft. The arms support a plank which constitutes a backstop. A cushion is disposed between the arms and the plank.

6 Claims, 4 Drawing Figures

10
11
12
13
14
15
16
17
18
19
20
21
22
23
24
25
26
27
28
A
B

FLEXIBLE PLANK SUPPORT UNIT

BACKGROUND OF THE INVENTION

The present invention relates to an automatic pinsetting maching used in bowling and, more particularly, to a flexible plank support unit for limiting the movement of bowling pins struck by the ball.

The plank support unit is designed to prevent bowling pins from hitting the operating mechanism of the pin spotting machine, or from being deflected out of the pit area. A typical prior art plank support unit is disclosed in U.S. Pat. No. 2,803,462 issued Aug. 20, 1957 which disclosure is hereby incorporated by reference. The prior art unit is rigidly constructed to withstand the impact of the bowling ball and the bowling pins. Unfortunately, the prior art unit frequently cracks in use necessitating shutting down the pinsetting machine while the damaged unit is removed and replaced. If a replacement is not available, the pinsetting machine is out of service until the damaged unit is repaired and replaced. Cracked units are repaired by welding. The cost of repair of the unit and the loss of the use of the pinsetting machine unit the repair is completed are unavoidable and costly expenses with which the bowling industry has heretofore been faced.

OBJECTS OF THE INVENTION

It is an object of the present invention to provide a flexible plank support unit which overcomes the disadvantages of the prior art. Another object is to provide a durable, long lasting flexible plank support unit. A further object is to provide a flexible plank support unit highly resistant to damage caused by forces to which a flexible plank support unit is normally subjected. Still another object is to provide a flexible plank support unit which is not subject to frequent cracking during use. Yet another object is to provide a flexible plank support unit which is readily removed and replaced. These and other objects of the present invention will be apparent from the following description.

SUMMARY OF THE INVENTION

Figures 1, 2, 3, 4:
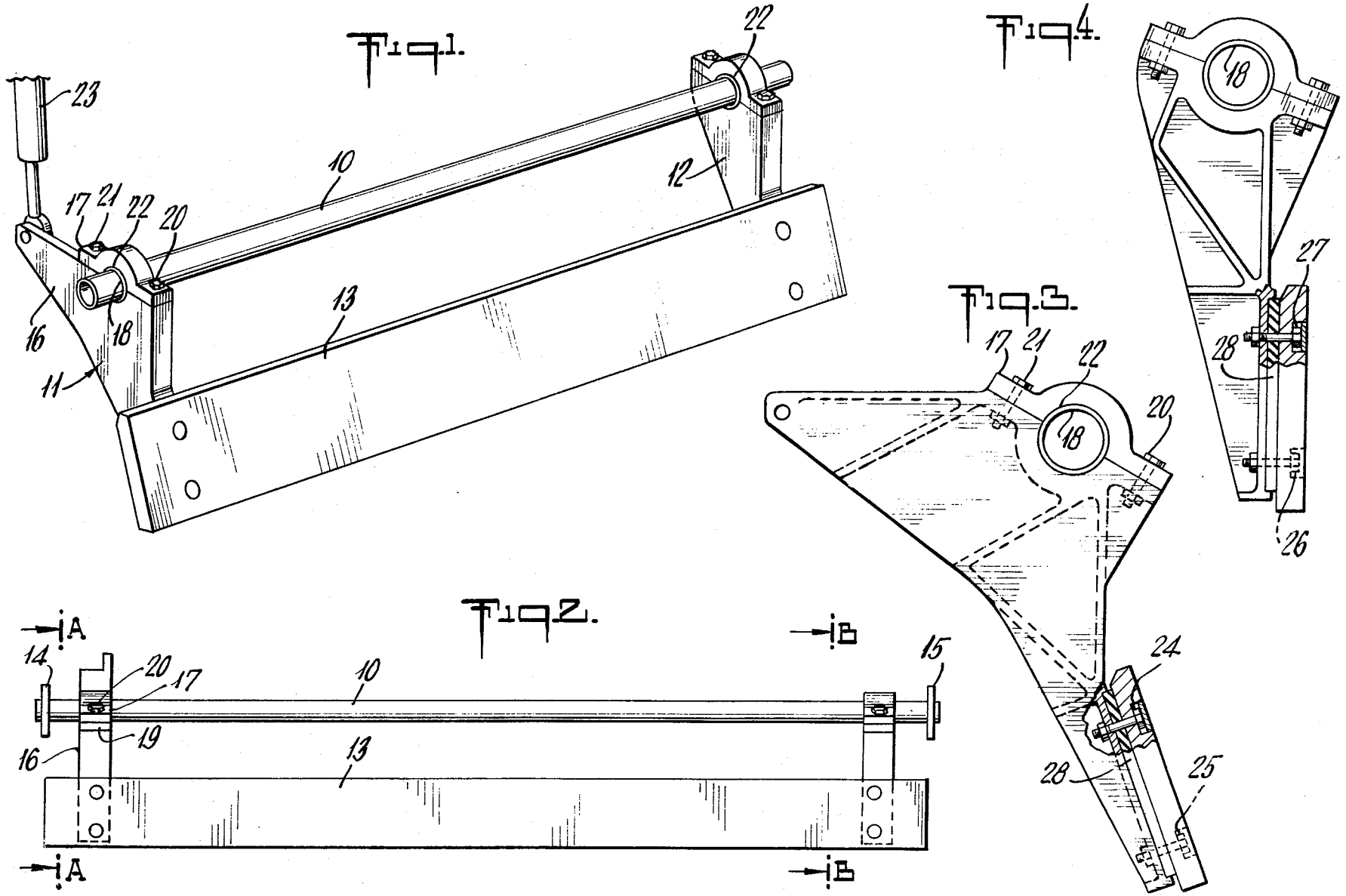
FIG. 1 is a perspective view of the flexible plank support unit of the present invention.
FIG. 2 is a front elevation.
FIG. 3 is a side elevation taken along the line B—B of FIG. 2.
FIG. 4 is a side elevation taken along the line A—A of FIG. 2.

The horizontal shaft of a plank support unit is attached by flexible cushioned means to the supporting arms. Cushioning means may also be provided between the backstop and the supporting arms.

DETAILED DESCRIPTION

As shown in the drawings the flexible plant, support unit of the present invention comprises a horizontal shaft 10 extending transversely across the rear end of the pit; supporting arms 11 and 12 having a generally triangular shape and backstop 13. The shaft 10 is supported on each end by suitable bearing barackets 14 and 15, shown in FIG. 2. Supporting arms 11 and 12 are fulcrumed on horizontal shaft 10. Supporting arm 11 consists of a larger lower portion 16 and a smaller upper portion 17. Each portion has a semi-circular channel which together form a circular opening 18 which receives horizontal shaft 10. Lower portion 16 has a flange 19 having holes which register with corresponding holes in upper portion 17 to receive bolts 20 and 21 which attach portions 16 and 17 to one another. Cushioning means 22 is positioned in circular opening 18 between horizontal shaft 10 and the upper and lower portions of supporting arm 11. The identical arrangement is used for the other supporting arm 12. A shock absorber mounting 23 is attached to either the forward part of lower portion 16 or to the corresponding part of the other supporting arm or may be attached to both supporting arms. If only a single shock absorber mounting is used, the forward part of lower portion not connected to the shock absorber may be eliminated as shown in FIG. 4.

The backstop 13 is attached to the bottom part of the lower portions of the supporting arms by bolts 24, 25, 26 and 27 as shown in FIGS. 3 and 4. Cushioning material 28 may be positioned between the backstop and the bottom part of the supporting arms.

The cushioning material 22 and 28 may be any suitable cushioning material, e.g. elastomers such as neoprene, rubber, polyurethane and the like having a durometer hardness of from about 40 to about 60, or from about 45 to about 55, or about 50. A specific example is neoprene rubber having a thickness of from about 1/16 inch to about ⅝ inch, typically about ¼ inch. The supporting arms may be made of various materials, e.g., aluminum or steel while the backstop typically is formed of wood.

Because the supporting arms of the present invention are not formed of a single metallic member, they are inherently better able to withstand the stresses and strains when any part of the pin curtain assembly is hit by a bowling ball or pin. In addition, still greater ability to withstand such forces is provided by the cushioning means 18 between the supporting arms 11 and 12 and the horizontal shaft 10, as well as the cushioning means 28 between the backstop 13 and the supporting arms 11 and 12.

What is claimed is:

1. In a flexible plank support unit for an automatic pinsetting machine comprising a horizontal shaft, a pair of supporting arms fulcrumed on the horizontal shaft and a backstop attached to the bottom part of the supporting arms, the improvement which comprises forming each supporting arm of separate upper and lower portions, each portion having a channel, the two channels forming an opening to receive the shaft, the upper and lower portions being detachably secured to one another around the horizontal shaft, and cushioning means positioned between the shaft and the upper and lower portions of each supporting arm.

2. A flexible plank support unit according to claim 1 wherein cushioning means are positioned between the backstop and the supporting arms.

3. A flexible plank support unit according to claim 1 wherein the supporting arms are formed of cast aluminum.

4. A flexible plank support unit according to claim 1 wherein the cushioning means is an elastomer having a durometer hardness of from about 40 to about 60.

5. A flexible plank support unit according to claim 4 wherein the durometer hardness is from about 45 to 55.

6. A flexible plank support unit according to claim 4 wherein the durometer hardness is about 50.

* * * * *